US011673395B2

(12) United States Patent
Fukui et al.

(10) Patent No.: US 11,673,395 B2
(45) Date of Patent: Jun. 13, 2023

(54) INK-JET PRINTER AND INK-JET PRINTING METHOD

(71) Applicant: SCREEN Holdings Co., Ltd., Kyoto (JP)

(72) Inventors: Tamio Fukui, Kyoto (JP); Takashi Kuroda, Kyoto (JP); Kazutaka Ikeuchi, Kyoto (JP); Norimasa Matsui, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/093,688

(22) Filed: Nov. 10, 2020

(65) Prior Publication Data

US 2021/0138791 A1 May 13, 2021

(30) Foreign Application Priority Data

Nov. 12, 2019 (JP) ..... JP2019-204494

(51) Int. Cl.
*B41J 2/165* (2006.01)

(52) U.S. Cl.
CPC .. *B41J 2/16552* (2013.01); *B41J 2002/16555* (2013.01)

(58) Field of Classification Search
None
See application file for complete search history.

(56) References Cited

U.S. PATENT DOCUMENTS

2007/0263059 A1 11/2007 Watanabe et al.
2011/0273510 A1* 11/2011 Sugimoto ..... B41J 3/543 347/22
2012/0050398 A1* 3/2012 Yamagishi ..... B41J 11/007 347/30
2012/0281041 A1 11/2012 Leoni et al. ..... 347/25
(Continued)

FOREIGN PATENT DOCUMENTS

JP 2007-301918 A 11/2007
JP 2012-051127 A 3/2012
(Continued)

OTHER PUBLICATIONS

Extended European Search Report dated Mar. 24, 2021 for corresponding European Patent Application No. 20206661.9.
(Continued)

*Primary Examiner* — Alejandro Valencia
(74) *Attorney, Agent, or Firm* — Ostrolenk Faber LLP

(57) ABSTRACT

An ink-jet printer includes: a base material transport mechanism for transporting a base material along a transport path in a transport direction; an ink ejection head having a lower surface opposed to the transport path, and an ink ejection port for ejecting ink toward the transport path; and a base plate having a lower surface opposed to the transport path over the transport path, and a mounting hole open in the lower surface, the ink ejection head being mounted in the mounting hole. The base plate includes an air flow hole that is a though hole penetrating through the base plate. The air flow hole has an air outlet open in a location downstream of the ink ejection port in the lower surface. Air passing through the air flow hole is ejected from the air outlet toward the transport path.

8 Claims, 9 Drawing Sheets

(56) References Cited

U.S. PATENT DOCUMENTS

| | | | | |
|---|---|---|---|---|
| 2015/0165770 | A1 | 6/2015 | Miyakoshi et al. | |
| 2015/0165771 | A1 | 6/2015 | Iwasa | |
| 2015/0273835 | A1* | 10/2015 | Arimizu | B41J 2/1714 347/30 |
| 2016/0107455 | A1 | 4/2016 | Izawa et al. | |
| 2016/0214383 | A1 | 7/2016 | Kobayashi | |
| 2017/0217192 | A1* | 8/2017 | Imahashi | B41J 2/16585 |
| 2017/0225497 | A1* | 8/2017 | Sekimoto | B41J 2/165 |
| 2019/0173010 | A1 | 6/2019 | Lee et al. | |

FOREIGN PATENT DOCUMENTS

| | | | |
|---|---|---|---|
| JP | 2015-134496 | A | 7/2015 |
| JP | 2015-193219 | A | 11/2015 |
| JP | 2016-137672 | A | 8/2016 |
| JP | 2018-158545 | A | 10/2018 |

OTHER PUBLICATIONS

Japanese Office Action dated Apr. 18, 2023 in corresponding Japanese Patent Application No. 2019-204494, with translation.

* cited by examiner

INK-JET PRINTER AND INK-JET PRINTING METHOD

RELATED APPLICATIONS

This application claims the benefit of Japanese Application No. 2019-204494, filed on Nov. 12, 2019, the disclosure of which is incorporated by reference herein.

BACKGROUND OF THE INVENTION

Field of the Invention

The present invention relates to a technique for printing based on ink-jet technology.

Description of the Background Art

It is known that ink mist is generated in an ink-jet printer when minute ink droplets are ejected toward a base material. If the ink mist adheres to and accumulates on the interior of the printer, for example, around ink ejection ports, the ink mist can become large ink droplets which in turn fall on the base material. This can become a factor in reducing printing quality.

Japanese Patent Application Laid-Open No. 2015-134496 discloses the provision of an ink mist collection unit in a location downstream of a recording head as seen in the transport direction of the base material. The ink mist collection unit includes a sucking port opposed to the base material to suck in air present above the base material together with the ink mist through the sucking port.

In the background art printer, it is necessary to provide the ink mist collection unit around the recording head. This results in apprehension that the printer is increased in size. In particular, when the printer includes a plurality of recording heads, the provision of the ink mist collection unit for each of the recording heads causes a significant increase in printer size. Thus, there has been a need for a technique for removing ink mist without an increase in printer size.

SUMMARY OF THE INVENTION

It is therefore an object of the present invention to provide a technique for reducing ink mist adhering to a printer while suppressing an increase in printer size.

According to one aspect of the present invention, an ink-jet printer comprises: a base material transport mechanism for transporting a base material along a transport path in a transport direction; at least one ink ejection head having a lower surface opposed to the transport path over the transport path, and an ink ejection port open toward the transport path in the lower surface and for ejecting ink toward the transport path; and a base plate having an opposite surface opposed to the transport path over the transport path, and at least one mounting hole open in the opposite surface, the ink ejection head being mounted in the mounting hole, the base plate including an air flow hole that is a though hole penetrating through the base plate, the air flow hole having at least one air outlet open in a location downstream of the ink ejection port in the opposite surface, wherein air passing through the air flow hole is ejected from the air outlet toward the transport path.

Ink mist generated in the ink ejection port is caused to adhere to the base material by a downflow of air ejected from the air outlet downstream of the ink ejection port. This reduces the adhesion of the ink mist to the base plate. Also, the ink mist is removed by the provision of the air flow hole and the air outlet in the base plate to which the ink ejection head is mounted. This achieves the reduction in size of the printer, as compared with the provision of a mechanism for sucking in the ink mist.

Preferably, the air flow hole is formed by an outer surface of the ink ejection head disposed inside the mounting hole and an inner surface of the mounting hole.

The ink-jet printer, in which the air flow hole is formed by the outer surface of the ink ejection head and the inner surface of the mounting hole, allows the air outlet to be provided in a position immediately adjacent to a downstream portion of the ink ejection head. This reduces the ink mist adhering to the base plate supporting the ink ejection head after being generated in the ink ejection port of the ink ejection head.

Preferably, a distance between the opposite surface and the transport path in a location downstream of the air outlet is greater than a distance between the opposite surface or the lower surface and the transport path in a location upstream of the air outlet.

An air flow directed downstream from the air outlet is easily formed because the distance between the opposite surface and the transport path in a location downstream of the air outlet is greater than the distance between the opposite surface or the lower surface and the transport path in a location upstream of the air outlet. This allows the ink mist to move downstream of the air outlet.

Preferably, the ink-jet printer further comprises an air supply unit provided at the upper side of the base plate and for supplying air directed toward the air outlet to the air flow hole.

The supply of air directed toward the air outlet to the air flow hole from over the base plate allows the air to be ejected from the air outlet.

Preferably, the air supply unit supplies air to an outer surface of the ink ejection head.

The supply of air to the outer surface of the ink ejection head allows the ink ejection head to cool.

Preferably, the at least one mounting hole in the base plate includes a plurality of mounting holes, and the at least one ink ejection head includes a plurality of ink ejection heads. The ink ejection heads are mounted in the respective mounting holes. The at least one air outlet includes a plurality of air outlets. The base plate includes the air outlets positioned downstream of the ink ejection ports of the respective ink ejection heads.

The ink mist generated in the ink ejection heads are restrained from adhering to the base plate because the air outlets are provided downstream of the ink ejection heads.

Preferably, the amount of air ejected from a downstream one of the air outlets is less than the amount of air ejected from an upstream one of the air outlets.

The amount of air ejected from the downstream air outlet is less than the amount of air ejected from the upstream air outlet, whereby a flow of air directed downstream is easily formed over the base material.

Preferably, the ink-jet printer further comprises an air-permeable filter member positioned in the air flow hole.

The air-permeable filter member disposed in the air flow hole allows the adjustment of the amount of air ejected from the air outlet.

Preferably, a gap of the air flow hole in the transport direction is smaller than a distance between the opposite surface and the transport path in a location downstream of the air outlet.

This allows the ejection of uniform air from the air outlet toward the transport path.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
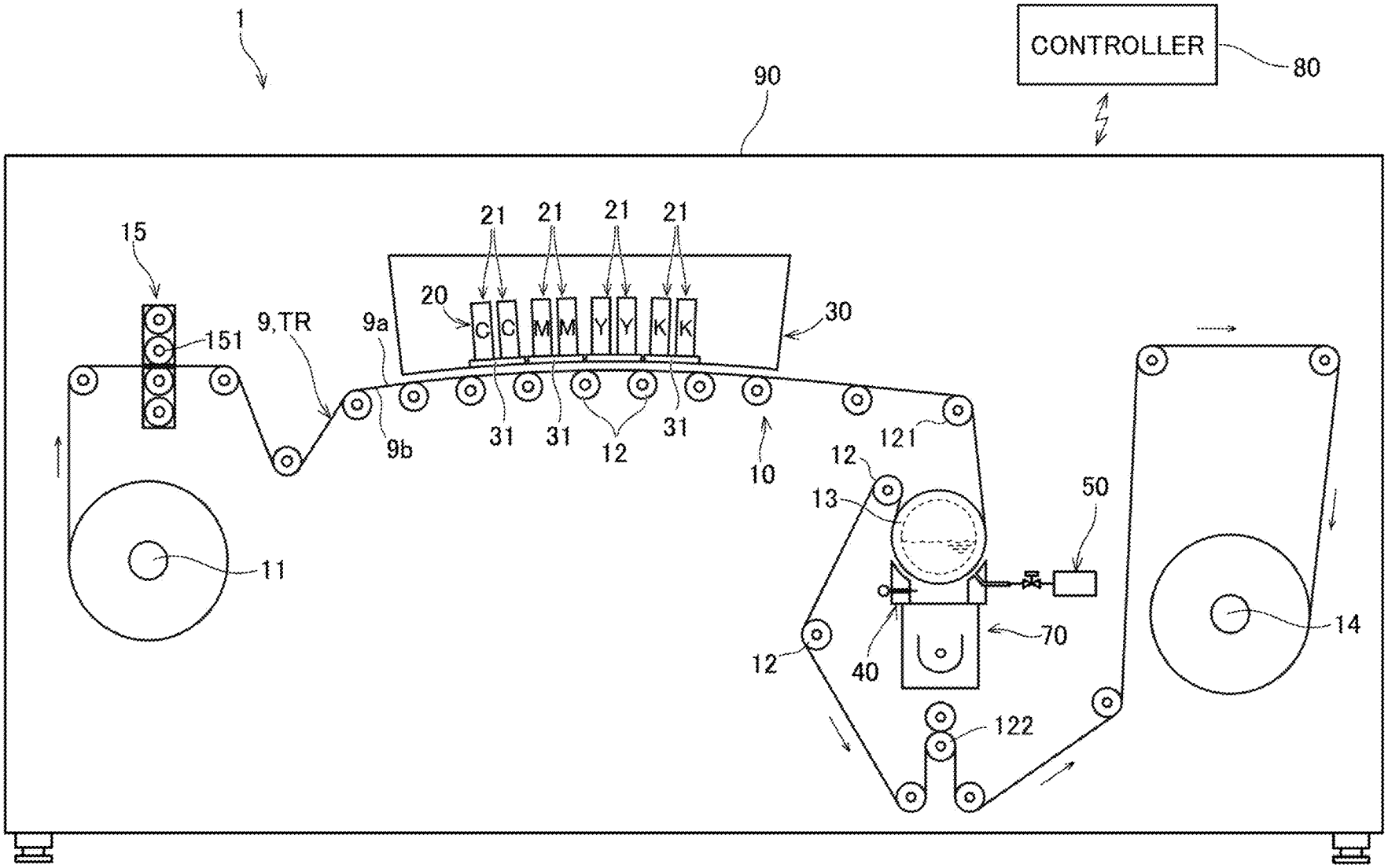
FIG. 1 is a diagram schematically showing a configuration of an ink-jet printer according to a first preferred embodiment of the present invention.

Preferred embodiments according to the present invention will now be described with reference to the drawings. Components described in the preferred embodiments are merely illustrative, and there is no intention to limit the scope of the present invention thereto. In the drawings, the dimensions of components and the number of components are shown in exaggeration or in simplified form, as appropriate, for the sake of easier understanding in some cases.

1. First Preferred Embodiment

FIG. 1 is a diagram schematically showing a configuration of an ink-jet printer 1 according to a first preferred embodiment of the present invention. The ink-jet printer 1 is an apparatus for printing an image on a recording surface 9*a* of a strip-shaped base material 9 (e.g., printing paper) by ejecting ink droplets from a plurality of ink ejection heads 21 while transporting the base material 9. Ultraviolet curable inks which are cured when irradiated with ultraviolet rays that are electromagnetic waves are used in the ink-jet printer 1. The ultraviolet curable inks can contain a curing initiator for accelerating the curing as an ingredient. Inks (e.g., water-based inks or oil-based inks) other than the ultraviolet curable inks may be used in the ink-jet printer 1. In this case, an irradiator 70 described later may be omitted.

The ink-jet printer 1 includes a base material transport mechanism 10, an image recording unit 20, a support unit 30, a process chamber 40, an inert gas supply unit 50, an irradiator 70, and a controller 80. The components (including the image recording unit 20 and the process chamber 40) other than the controller 80 are housed in a box-like casing 90.

The base material transport mechanism 10 is a mechanism for transporting the base material 9 in a direction extending along the length of the base material 9. The base material transport mechanism 10 includes an unwinding unit 11, a plurality of transport rollers 12, a chill roller 13, and a winding unit 14. The transport rollers 12 include a direction switching roller 121 and nip rollers 122 to be described later. The base material 9 is unwound from the unwinding unit 11, and is transported along a transport path formed by the transport rollers 12. Each of the transport rollers 12 rotates about a horizontal axis to guide the base material 9 downstream in the direction of movement of the base material 9. The transported base material 9 is wound and collected on the winding unit 14. In this manner, the base material 9 is transported along a fixed transport path TR by being supported by the transport rollers 12, the chill roller 13, and the like which are disposed in fixed positions.

In the following description, the direction in which the base material 9 moves along the transport path TR is referred to simply as a "transport direction". The term "downstream" as simply used herein refers to being downstream as seen in the direction of movement of the base material 9, and the term "upstream" as simply used herein refers to being upstream as seen in the direction of movement of the base material 9. In addition, a direction orthogonal to the direction of movement of the base material 9 and parallel to a surface of the base material 9 is referred to as a "width direction".

As shown in FIG. 1, the base material 9 initially passes through a cleaner 15 after being unwound from the unwinding unit 11. The cleaner 15 includes a plurality of suction rolls 151 disposed vertically in proximity to each other. The suction rolls 151 rotate while contacting the recording surface 9*a* and a back surface 9*b* of the base material 9. Foreign materials adhering to the recording surface 9*a* and the back surface 9*b* are removed by suction by the suction rolls 151. This reduces the number of foreign materials adhering to the base material 9 before printing to accordingly reduce printing failures such as ink rejected or exuded by the foreign materials. The cleaner 15 may be of other types such as sucking mechanism as an example than the suction rolls 151.

After passing through the cleaner 15, the base material 9 is moved substantially horizontally under the image recording unit 20 in a direction in which the ink ejection heads 21 are arranged. During this movement, the recording surface 9*a* of the base material 9 faces upwardly (toward the ink ejection heads 21). The direction switching roller 121, the chill roller 13, and the nip rollers 122 are disposed downstream of the image recording unit 20.

Although not shown, a static eliminator mechanism (ionizer) may be disposed downstream of the cleaner 15 and upstream of the image recording unit 20. The static eliminator mechanism removes static electricity from the base material 9. The base material 9 from which foreign materials and static electricity are removed is supplied to the image recording unit 20 because the cleaner 15 and the static eliminator mechanism are disposed upstream of the image recording unit 20 in this manner.

The nip rollers 122 rotate actively at a constant speed while grasping the base material 9 by contacting the recording surface 9*a* and the back surface 9*b* of the base material 9. The base material transport mechanism 10 adjusts the rotation speed of the unwinding unit 11 with respect to the rotation speed of the nip rollers 122. This applies tension to the base material 9. As a result, slack and wrinkles in the base material 9 are prevented during the transport.

The image recording unit 20 is a mechanism for ejecting ultraviolet curable inks toward the base material 9 being transported by the base material transport mechanism 10. The image recording unit 20 includes four types of ink ejection heads 21 different in ink color for ejection. The ink ejection heads 21 are arranged in the direction of movement of the base material 9. At the time of printing, ink droplets of four colors, i.e. cyan (C), magenta (M), yellow (Y), and black (K), which are color components of a color image are ejected from the four types of ink ejection heads 21 toward the recording surface 9*a* of the base material 9. This forms a color image on the recording surface 9*a* of the base material 9. The step of ejecting the inks from the ink ejection heads 21 toward the base material 9 is an example of an ink ejection step. The ink-jet printer 1 may include an additional ink ejection head for ejecting another color ink (e.g., white ink).

The support unit 30 includes a plurality of base plates 31 arranged along the transport path TR of the base material 9, and a pair of support frames 32, 32 (with reference to FIG. 3) for supporting opposite end portions of each of the base plates 31 as seen in the width direction. The two support frames 32, 32 extend substantially parallel to the transport path TR, and are arranged in spaced parallel relation in the width direction. The base plates 31 are arranged in spaced relation in the transport direction.

The ink ejection heads 21 are mounted on the base plates 31. This supports the ink ejection heads 21 and fixes the mutual positional relationship between the ink ejection heads 21. Each of the base plates 31 includes through holes (mounting holes 311 to be described later) through which lower end portions of the respective ink ejection heads 21 is inserted. Thus, lower surfaces 212 of the ink ejection heads 21 mounted to the base plates 31 are opposed to the recording surface 9*a* of the base material 9 without being obstructed by the base plates 31. Further detailed structures of the image recording unit 20 and the support unit 30 will be described later in detail.

As shown in FIG. 1, the direction switching roller 121 is disposed downstream as viewed from the image recording unit 20. The direction switching roller 121 rotates about a horizontal axis extending in the width direction while contacting the back surface 9*b* of the base material 9. This causes the base material 9 to be bent in a direction opposite to the recording surface 9*a*. As a result, the direction of movement of the base material 9 is changed from a first direction (a substantially horizontal direction in the present preferred embodiment) to a second direction (a vertically downward direction in the present preferred embodiment).

The direction switching roller 121 contacts the back surface 9*b* of the base material 9. For this reason, the surface of the direction switching roller 121 does not contact the inks in an uncured state. This suppresses the reduction in image quality on the base material 9 resulting from the contact with the direction switching roller 121. Also, there are no members for changing the direction of movement of the base material 9 on the recording surface 9*a* side of the base material 9.

The chill roller 13 rotates about a horizontal axis extending in the width direction while contacting the back surface 9*b* of the base material 9. The chill roller 13 is disposed substantially vertically above the process chamber 40 and the irradiator 70. The chill roller 13 has an outer surface with a diameter greater than the diameters of the outer surfaces of the transport rollers 12 which are disposed upstream and downstream of the chill roller 13. Cooling water is stored inside the chill roller 13. The cooling water is circulated as appropriate by a circulator not shown. This cools the surface of the chill roller 13, so that the temperature thereof is maintained.

The process chamber 40 is disposed downstream of the image recording unit 20. The process chamber 40 has a carrying-in port and a carrying-out port for passage of the base material 9 therethrough. The process chamber 40 is covered with an outer surface 13S of the chill roller 13 from above.

The inert gas supply unit 50 supplies an inert gas (such as nitrogen gas) to the inside of the process chamber 40 to fill the inside of the process chamber 40 with a high concentration of inert gas. More specifically, the inert gas supply unit 50 supplies nitrogen gas that is an inert gas toward the recording surface 9*a* of the base material 9 present inside the process chamber 40.

The irradiator 70 is disposed downstream of the inert gas supply unit 50 and substantially vertically below the chill roller 13. Also, the irradiator 70 is disposed immediately under the process chamber 40. The irradiator 70 performs an irradiation process for irradiating the base material 9 supported by the chill roller 13 with irradiation light. The irradiation light from the irradiator 70 includes ultraviolet light of a wavelength band effective in curing the inks, and has a sufficient amount of light. When the inks on the base material 9 are subjected to the irradiation process, the inks are cured and fixed on the base material 9. Thus, an image is recorded on the recording surface 9*a* of the base material 9.

The controller 80 is formed by a computer including an arithmetic processor such as a CPU, a memory such as a RAM, and a storage part such as a hard disk drive. The controller 80 is electrically connected to the unwinding unit 11, the winding unit 14, the ink ejection heads 21, the irradiator 70, and the nip rollers 122, for example. The controller 80 temporarily reads a computer program stored in the storage part onto the memory. The arithmetic processor performs arithmetic processing based on the computer program, so that the controller 80 controls the operations of the aforementioned components. Such control causes the printing process in the ink-jet printer 1 to proceed.

Figure 2:
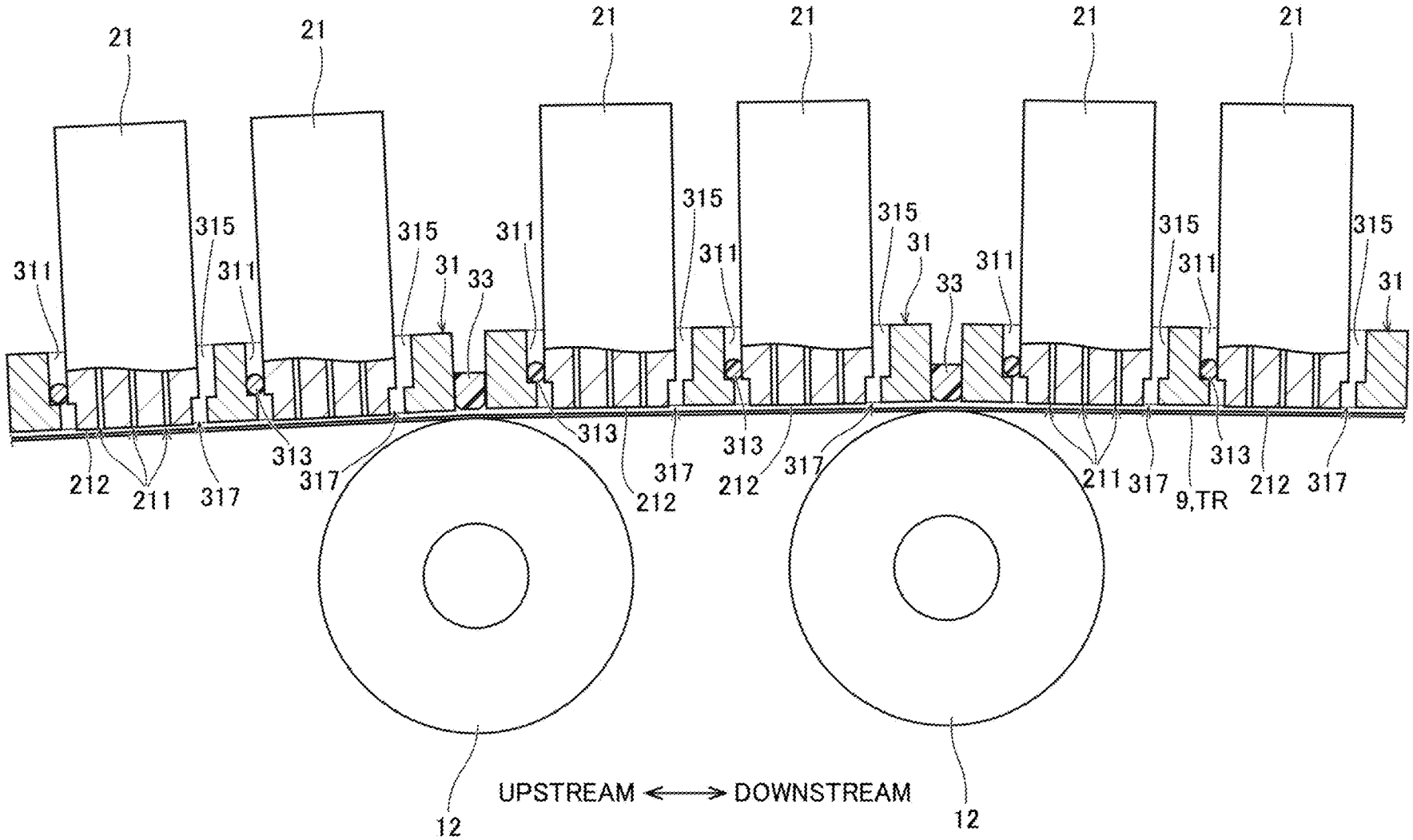
FIG. 2 is a vertical sectional view of an image recording unit and a support unit.
Figure 3:
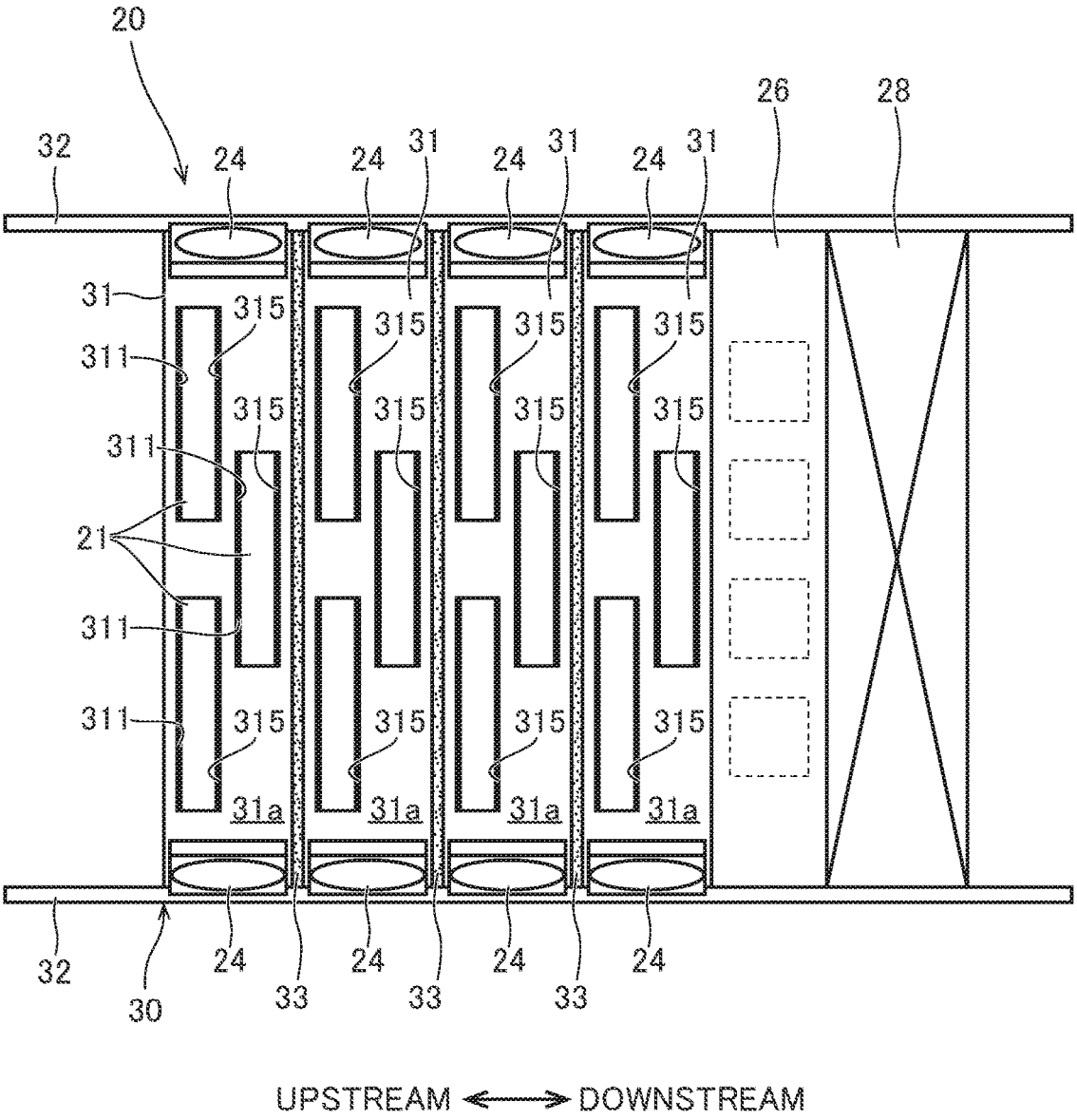
FIG. 3 is a plan view of the image recording unit.
Figure 4:
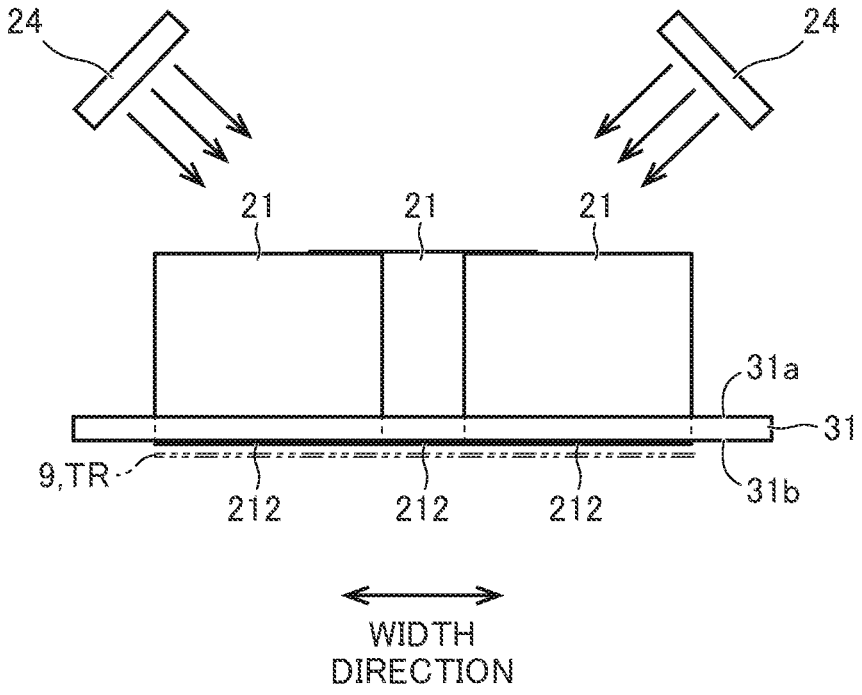
FIG. 4 is a schematic front view of a base plate, ink ejection heads, and fans.
Figure 5:
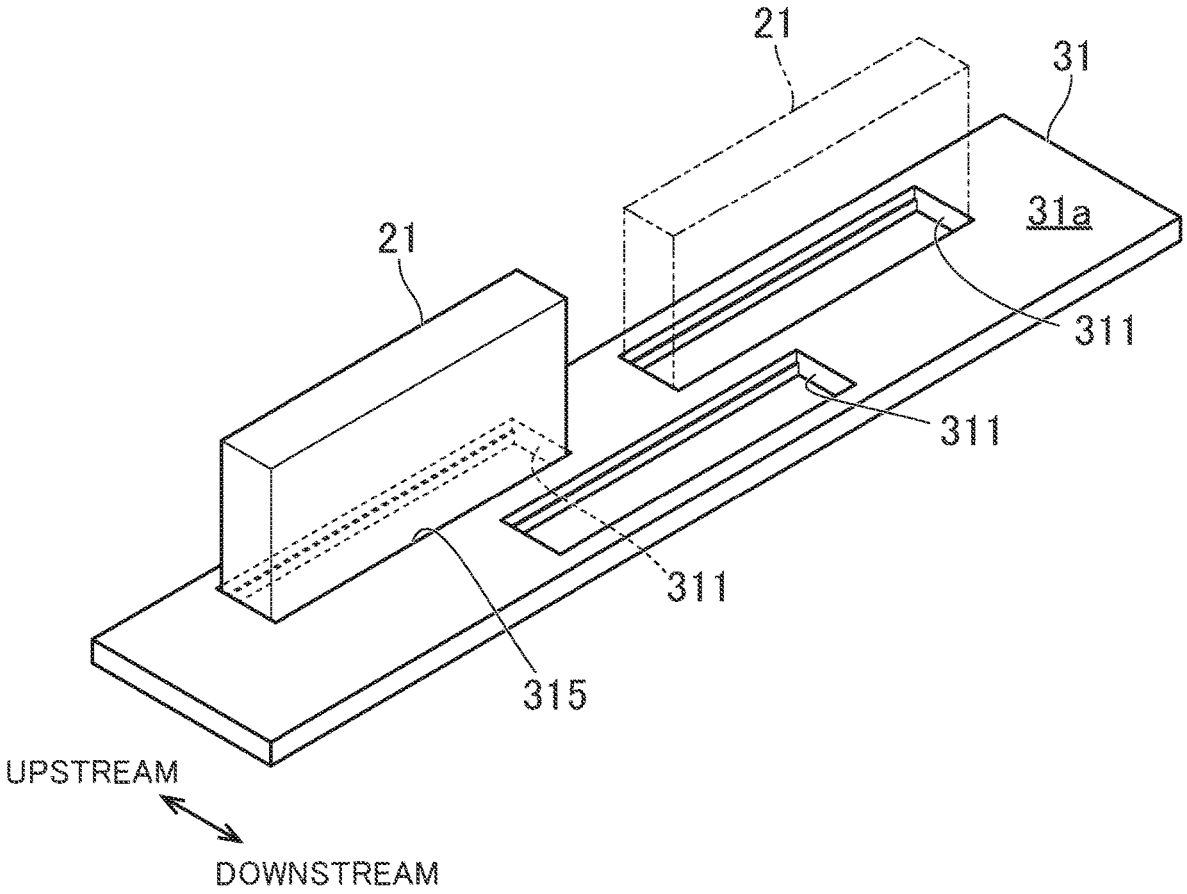
FIG. 5 is a perspective view of the base plate and the ink ejection heads.
Figure 6:
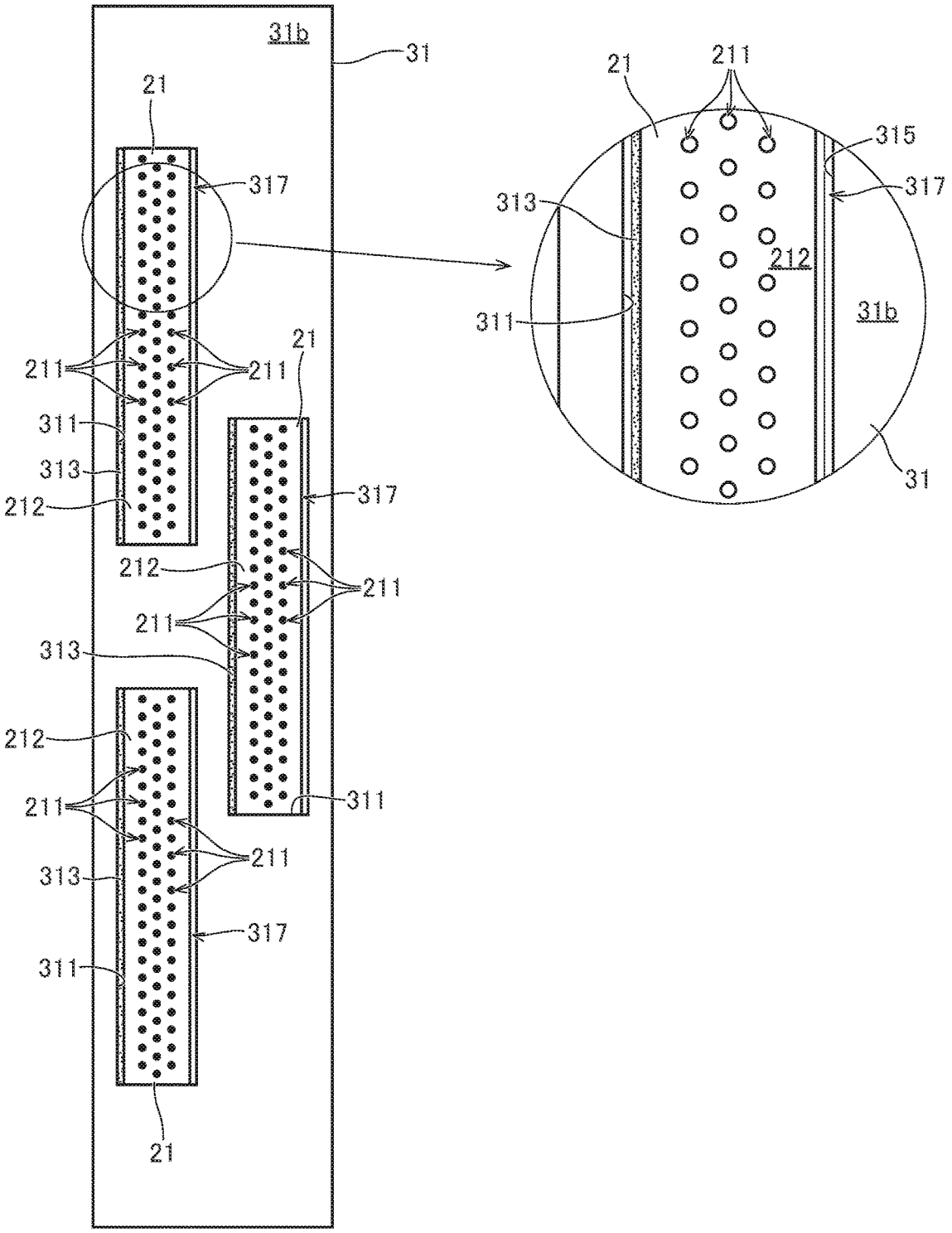
FIG. 6 is a view showing lower surfaces of the ink ejection heads and a lower surface of the base plate.

FIG. 2 is a vertical sectional view of the image recording unit 20 and the support unit 30. FIG. 3 is a plan view of the image recording unit 20. FIG. 4 is a schematic front view of a base plate 31, the ink ejection heads 21, and fans 24. FIG. 5 is a perspective view of the base plate 31 and the ink ejection heads 21. FIG. 6 is a view showing the lower surfaces 212 of the ink ejection heads 21 and a lower surface 31*b* of the base plate 31.

As shown in FIGS. 2 and 6, the ink ejection heads 21 are disposed over the transport path TR. The ink ejection heads 21 have the respective lower surfaces 212. The lower surfaces 212 of the ink ejection heads 21 are opposed to the transport path TR. The lower surfaces 212 of the ink ejection heads 21 each have a plurality of ink ejection ports 211 open toward the transport path TR and for ejecting ink droplets. The ink ejection ports 211 are arranged regularly in the width direction. As shown in FIG. 2, the ink ejection heads 21 are fixed to the base plates 31, with lower end portions of the respective ink ejection heads 21 fitted in the mounting holes 311 provided in the base plates 31. The lower surfaces 212 of the ink ejection heads 21 are flat surfaces each provided with the plurality of ink ejection ports 211. The lower surfaces 212 are disposed substantially parallel to the recording surface 9*a* of the base material 9.

As shown in FIGS. 1 and 2, the transport rollers 12 immediately under the image recording unit 20 are disposed in the form of an arch that is convex upward. Thus, the base material 9 immediately under the image recording unit 20 is transported while being curved in an upwardly convex shape (convex toward the recording surface 9*a*). That is, the transport path TR immediately under the image recording unit 20 is curved in an upwardly convex shape. The base plates 31 are arranged along the curved shape of the transport path TR. This causes the ink ejection heads 21 to be arranged in the form of an arch along the transport path TR.

As shown in FIG. 5, the base plate 31 is a plate-like member having a rectangular shape as seen in plan view. The base plate 31 has three mounting holes 311 penetrating therethrough in the thickness direction. The mounting holes 311 are open in a rectangular shape extending in the width direction in an upper surface 31*a* and the lower surface 31*b* (opposite surface) of the base plate 31. Two of the three mounting holes 311 are positioned upstream, and the remaining one is positioned downstream. The two upstream mounting holes 311 are spaced apart in the width direction, and the one downstream mounting hole 311 is disposed in the middle of the two upstream mounting holes 311 as seen in the width direction. The three mounting holes 311 are disposed so that the opposite end portions of the one downstream mounting hole 311 as seen in the width direction overlap the two upstream mounting holes 311 as seen in the transport direction.

The lower end portions of the ink ejection heads 21 having a rectangular shape as seen in plan view are inserted in the three respective mounting holes 311 and fixed therein with fixtures such as screws. As shown in FIG. 2, the width of the mounting holes 311 as seen in the transport direction is greater than the width of the ink ejection heads 21 as seen in the transport direction. With the ink ejection heads 21 fixed in the mounting holes 311, through holes penetrating through the base plates 31 in the thickness direction are formed in locations upstream and downstream of the ink ejection heads 21.

As shown in FIGS. 2 and 6, a sealing material 313 is mounted in the through hole upstream of each of the ink ejection heads 21. The sealing material 313 is an elongated member extending in the width direction, and closes a gap between the upstream inner surface of a corresponding one of the mounting holes 311 and the upstream outer surface of each of the ink ejection heads 21. This suppresses the ejection of air from the upstream through hole to thereby suppress irregularities in trajectory of ink droplets ejected from each of the ink ejection heads 21.

As shown in FIG. 2, the upstream and downstream inner surfaces of the mounting holes 311 have inward protrusions in intermediate portions of the depth of the mounting holes 311, so that the width of the mounting holes 311 is smaller as seen in the transport direction in the intermediate portions. Thus, when inserted from above, the sealing materials 313 are locked at the upper surfaces of the inward protrusions in the respective mounting holes 311. This restrains the sealing materials 313 from falling downwardly through the base plates 31.

The through holes downstream of the ink ejection heads 21 are air flow holes 315. The air flow holes 315 have respective air outlets 317 open in the lower surface 31*b* (with reference to FIG. 6). The air outlets 317 eject air toward the base material 9 transported along the transport path. The air flow holes 315 form an air flow path directed from above the base plates 31 toward the air outlets 317.

As shown in FIGS. 3 and 4, the image recording unit 20 includes the plurality of fans 24. In this example, the fans 24 are disposed, two above each of the base plates 31. The two fans 24 are disposed, one on one side and one on the other side of each of the base plates 31 as seen in the width direction. Each of the fans 24 blows air downwardly and inwardly as seen in the width direction. As shown in FIG. 4, air from the fans 24 is supplied to the outer surfaces of the three ink ejection heads 21 mounted to the base plate 31. Thus, the ink ejection heads 21 are cooled. The air supplied from the fans 24 flows to the air flow holes 315 and is ejected from the air outlets 317. In this manner, the plurality of fans 24 is an example of an air supply unit for supplying air directed toward the air outlets 317 to the air flow holes 315.

Figure 7:
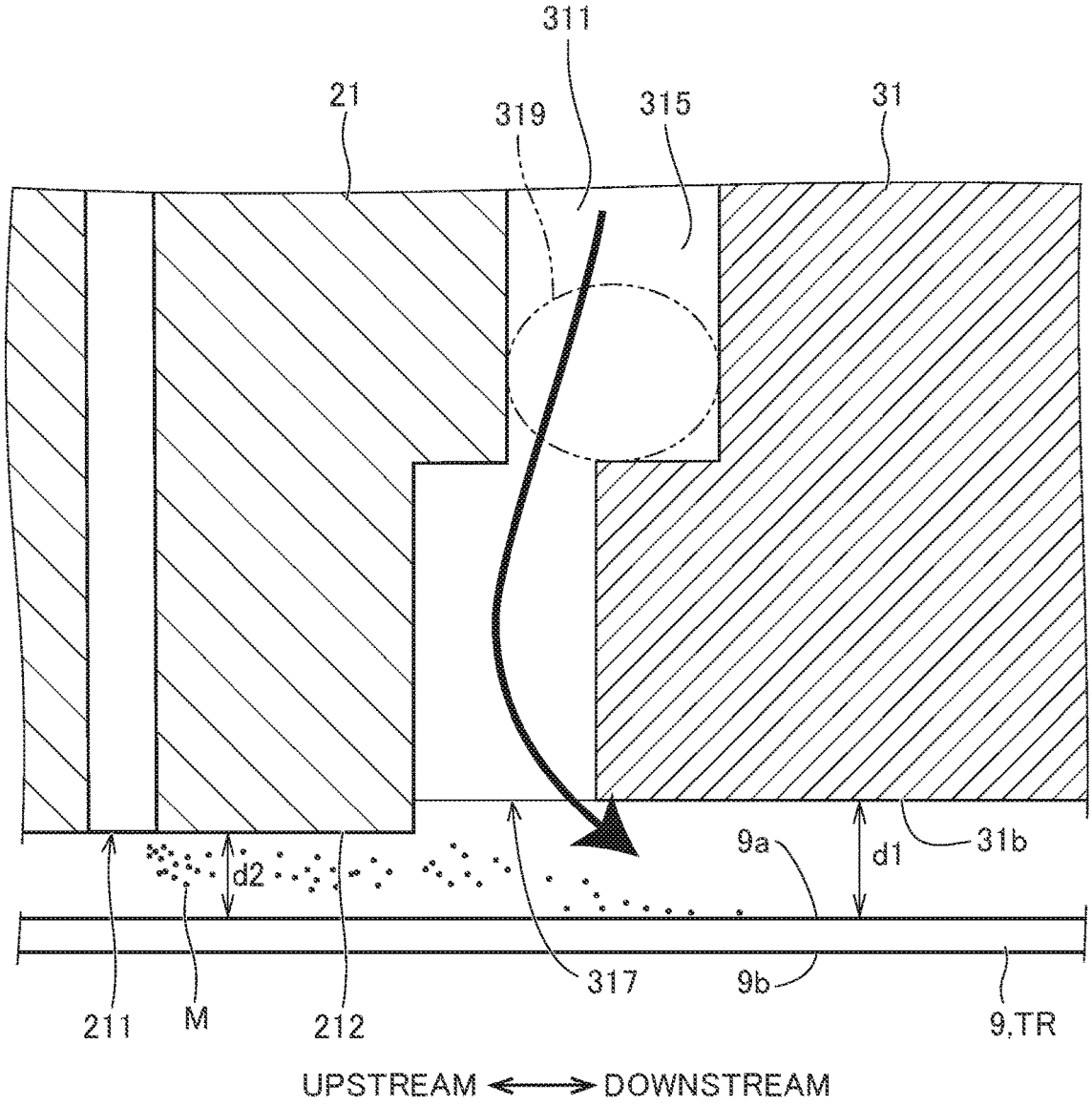
FIG. 7 is a vertical sectional view showing surroundings of an air flow hole and an air outlet on an enlarged scale.

FIG. 7 is a vertical sectional view showing surroundings of an air flow hole 315 and an air outlet 317 on an enlarged scale. As shown in FIG. 7, ink mist M generated from ink droplets and the like ejected from the ink ejection ports 211 is moved downstream by the movement of the base material 9 while floating between the base material 9 and the lower surface 212 of the corresponding ink ejection head 21. The ejection of air from the air outlet 317 in this state allows the ink mist M floating over the base material 9 to adhere to the base material 9. This reduces the adhesion of the ink mist M to the lower surface 31*b* of the base plate 31 and the like. The ink mist M is in very minute amounts as compared with the ink droplets ejected from the ink ejection ports 211 for image formation. For this reason, if the ink mist M adheres to the base material 9, the reduction in printing quality is small. Also, the adhesion of the ink mist M to the lower surface 31*b* of the base plate 31 or other locations is reduced. This reduces the frequency of cleaning by a user.

As shown in FIG. 7, the air flow hole 315 is formed by the inner surface of the mounting hole 311 and the outer surface of the ink ejection head 21. Thus, the air outlet 317 is provided in a position immediately adjacent to a downstream portion of the ink ejection head 21. This reduces the ink mist M adhering to the base plate 31 supporting the ink ejection head 21 after being generated in the ink ejection ports 211 of the ink ejection head 21.

As shown in FIG. 7, a distance d1 between the lower surface 31*b* of the base plate 31 and the base material 9 is greater than a distance d2 between the lower surface 212 of the ink ejection head 21 and the base material 9. The lower surface 31*b* of the base plate 31 is positioned downstream of the air outlet 317, and the lower surface 212 of the ink ejection head 21 is positioned upstream of the air outlet 317. As a result, the pressure loss in the gap space between the lower surface 31*b* of the base plate 31 and the base material 9 in a location downstream of the air outlet 317 is less than the pressure loss in the gap space between the lower surface 212 of the ink ejection head 21 and the base material 9 in a location upstream of the air outlet 317. In this manner, an air flow directed downstream of the air outlet 317 is easily formed by making the distance d1 downstream of the air outlet 317 greater than the distance d2 upstream of the air outlet 317. If air from the air outlet 317 is not guided downstream, a downstream air flow created over the base material 9 by the transport of the base material 9 and a downflow from the air outlet 317 mix with each other, which in turn can cause a turbulent flow. If such a turbulent flow is created, there is a likelihood that the floating ink mist M is swirled up to adhere to the base plate 31 or to the lower surface 212 of the ink ejection head 21. For this reason, the formation of the downstream air flow in the air outlet 317 as shown in FIG. 7 reduces the adhesion of the ink mist M to the base plate 31 and the like.

For the formation of the downstream air flow, the amount (flow rate) of air ejected from downstream ones of the air outlets 317 may be made less than the amount of air ejected from upstream ones of the air outlets 317. As an example, the amount of air ejected from the air outlets 317 may be decreased stepwise in the downstream direction.

An air-permeable filter member 319 may be provided inside the air flow hole 315, for example, as shown in FIG. 7 for purposes of adjusting the amount of air ejected from the air outlet 317. The provision of the filter member 319 imposes a limit on the passage of air through the air flow hole 315 to thereby reduce the amount of air ejected from the air outlet 317. Also, the provision of the filter member 319 allows the purification of air ejected from the air outlet 317. The amount of air supplied by the fans 24 may be controlled to change the amount of air supplied to the air flow hole 315, thereby adjusting the amount of air ejected from the air outlet 317.

As shown in FIGS. 2 and 3, a sealing material 33 is provided between every pair of base plates 31 adjacent to each other in the transport direction. The sealing material 33 extends in the width direction, and closes a gap between adjacent ones of the base plates 31. The sealing materials 33 restrain the air supplied from the fans 24 from passing through the gaps between the base plates 31. This suppresses irregularities in air flow over the base material 9 between the base plates 31, and also allows a greater amount of air to be ejected from the air outlets 317.

It is desirable that the lower surfaces of the sealing materials 33 are flush with (level with) the lower surfaces 31*b* of the base plates 31 positioned upstream and downstream thereof. This suppresses the creation of a turbulent flow and the like between the base plates 31 to thereby reduce the adhesion of the ink mist M to the base plates 31.

As shown in FIG. 6, the air outlets 317 extend in the width direction, and the length of the air outlets 317 as measured in the width direction is approximately equal to the length of the lower surfaces 212 of the ink ejection heads 21 as measured in the width direction. The air outlet 317 extends more outwardly in the width direction than the outermost ink ejection ports 211, 211 as seen in the width direction among the ink ejection ports 211 provided in the ink ejection head 21 adjacent to upstream of the air outlet 317. Thus, if ink mist M is generated from any of the ink ejection ports 211, the downflow from the air outlets 317 allows the ink mist M to adhere to the base material 9. This reduces the adhesion of the ink mist M to the lower surface 31*b* of a base plate 31 on which the ink ejection heads 21 are provided or to the lower surface 31*b* of a base plate 31 positioned more downstream.

In the present preferred embodiment, the air outlets 317 are provided in positions downstream of and immediately adjacent to all of the ink ejection ports 211 provided in the ink ejection heads 21. This effectively reduces the adhesion of the ink mist M to the lower surfaces 31*b* of the base plates 31 on which the ink ejection heads 21 are provided.

As shown in FIG. 3, the image recording unit 20 includes a light irradiator 26 and a suction port 28. The light irradiator 26 includes a light source such as an LED, and irradiates the recording surface 9*a* of the base material 9 with light from the light source. The light irradiator 26 is disposed downstream of the most downstream one of the ink ejection heads 21, and semi-cures the inks ejected onto the base material 9.

Although not shown, the suction port 28 has a slit-shaped suction opening opposed to the recording surface 9*a* of the base material 9 to suck in air through the suction opening. The suction port 28 sucks in air in a location downstream of the four base plates 31, whereby an air flow directed downstream is easily formed between each of the base plates 31 and the base material 9. This allows the ink mist M created in the ink ejection ports 211 to move downstream.

It is not essential to provide the suction port 28 near the light irradiator 26. For example, the suction port 28 may be provided in a position close to the direction switching roller 121 and the like. It is not essential to provide the suction port 28 in a location downstream of the light irradiator 26. The suction port 28 may be provided upstream of the light irradiator 26.

In the present preferred embodiment, the lower surfaces 31*b* of the base plates 31 have no suction openings for sucking an atmosphere present over the base material 9. The air flow holes 315 and the air outlets 317 are provided in the base plates 31 in the present preferred embodiment to form a downflow in positions close to the ink ejection ports 211. Therefore, the adhesion of the ink mist M is reduced while an increase in size of the printer is prevented.

2. Second Preferred Embodiment

A second preferred embodiment according to the present invention will be described. In the following description, components having the same functions as those described above are designated by like reference numerals and characters or like reference numerals and characters with alphabetic characters appended thereto, and will not be described in detail in some cases.

Figure 8:
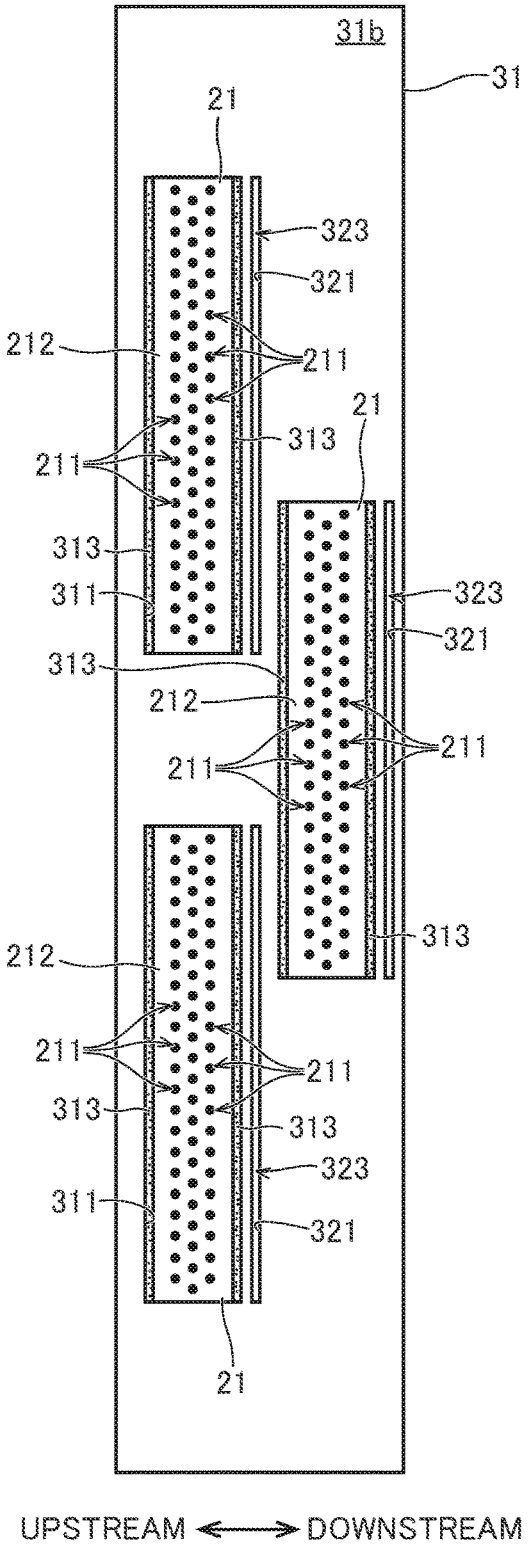
FIG. 8 is a view showing the lower surfaces of the ink ejection heads and the lower surface of the base plate according to a second preferred embodiment of the present invention.

FIG. 8 is a view showing the lower surfaces 212 of the ink ejection heads 21 and the lower surface 31*b* of the base plate 31 according to the second preferred embodiment of the present invention. The base plate 31 according to the present preferred embodiment includes air flow holes 321 positioned in downstream spaced apart relation to the respective mounting holes 311. Like the air flow holes 315, the air flow holes 321 are through holes penetrating through the base plate 31 in the thickness direction, and have respective air outlets 323 open in the lower surface 31*b* (opposite surface) of the base plate 31. The air outlets 323 are slit-shaped openings extending in the width direction, and are positioned so as to overlap all of the ink ejection ports 211 of the ink ejection heads 21 upstream adjacent thereto as seen in the transport direction. Gaps formed upstream and downstream of the ink ejection heads 21 inside the mounting holes 311 are closed by the respective sealing materials 313.

Also in the present preferred embodiment, the ejection of air from the air outlet 323 toward the base material 9 allows the ink mist M generated in the ink ejection ports 211 to adhere to the base material 9. This reduces the adhesion of the ink mist M to the base plate 31.

It is desirable that the distance between the lower surface 31*b* of the base plate 31 and the base material 9 in a location downstream of the air flow holes 321 is greater than the distance between the lower surface 31*b* of the base plate 31 and the base material 9 in a location upstream of the air flow holes 321 when the base plate 31 of the present preferred embodiment is opposed to the transport path TR. This allows an air flow directed downstream from the air outlets 317 to be easily formed.

Also, gaps formed downstream of the ink ejection heads 21 inside the mounting holes 311 may be used as the air flow holes 315, as in the first preferred embodiment.

3. Third Preferred Embodiment

Figure 9:
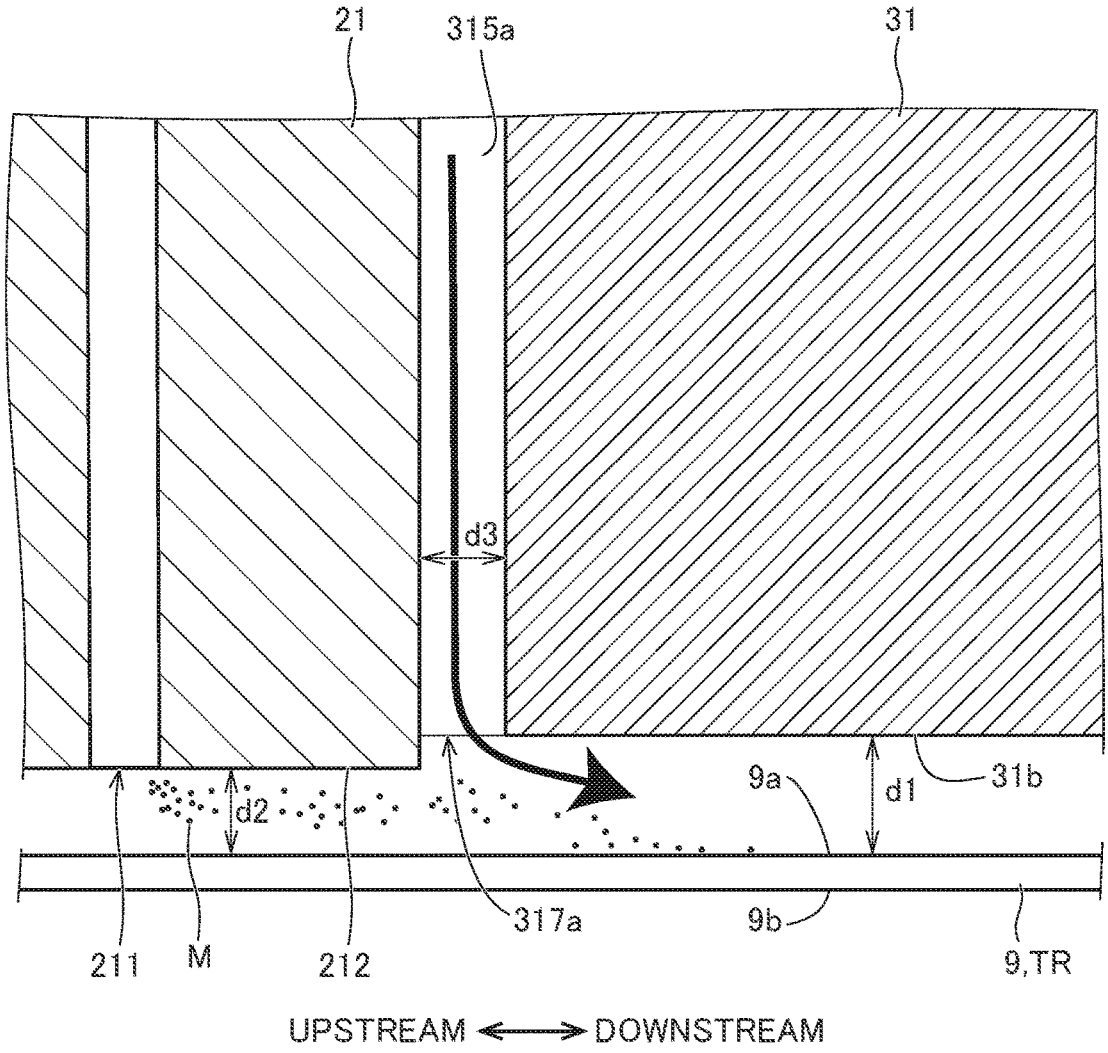
FIG. 9 is a vertical sectional view showing surroundings of the air flow hole and the air outlet on an enlarged scale according to a third preferred embodiment of the present invention.

FIG. 9 is a vertical sectional view showing surroundings of an air flow hole 315*a* and an air outlet 317*a* on an enlarged scale according to a third preferred embodiment of the present invention. Components identical with those described in FIG. 7 are designated by the same reference numerals and characters, and will not be described.

The air flow hole 315*a* shown in FIG. 9 is a slit-shaped hole short in length in the transport direction and elongated in the width direction. A gap d3 in the air flow hole 315*a* in the transport direction is less than the distance d1 between the lower surface 31*b* of the base plate 31 and the base material 9 in a location downstream of the air outlet 317*a*. As a result, the pressure loss in the interior space of the air flow hole 315*a* is less than the pressure loss in the gap space between the lower surface 212 of the ink ejection head 21 and the base material 9 in a location downstream of the air outlet 317*a*. This causes the air flowing to an upper portion of the air flow hole 315*a* to be shaped into a downflow having a uniform flow rate in the width direction inside the air flow hole 315*a*. This downflow is ejected from the air outlet 317*a* toward the base material 9.

4. Modifications

While the preferred embodiments according to the present invention have been described hereinabove, the present invention is not limited to the aforementioned preferred embodiments, but various modifications may be made.

The air outlets 317, 317*a*, and 323 in the aforementioned preferred embodiments are slit-shaped openings extending in the width direction. However, the air outlets may be a plurality of outlets disposed at a predetermined spacing in the width direction, for example, The air supply unit that forcedly supplies air to the air flow holes 315, such as the fans 24, is not essential. For example, the base material transport mechanism 10 moves the base material 9 downstream while holding the base material 9 close to the lower surfaces 31*b* of the base plates 31, whereby an air flow directed downstream is generated over the base material 9. The generation of the air flow over the base material 9 causes the atmosphere in the air flow holes 315 to be discharged from the air outlets 317, whereby a downflow is formed. In this manner, the downflow generated as the base material 9 moves may be used for the adhesion of the ink mist M to the base material 9.

While the invention has been shown and described in detail, the foregoing description is in all aspects illustrative and not restrictive. It is therefore understood that numerous modifications and variations can be devised without departing from the scope of the invention.

What is claimed is:

1. An ink-jet printer comprising:

a base material transport mechanism for transporting a base material along a transport path in a transport direction;

at least one ink ejection head having a lower surface opposed to said transport path over said transport path, and an ink ejection port open toward said transport path in said lower surface and for ejecting ink toward said transport path;

a base plate having an opposite surface opposed to said transport path over said transport path, and at least one mounting hole open in said opposite surface, said ink ejection head being mounted in said mounting hole, said base plate including an air flow hole that is a through hole penetrating through said base plate, said air flow hole having at least one air outlet open in a location downstream of said ink ejection port in said opposite surface, a sealing material; and an air supply unit provided at the upper side of said base plate and for supplying air directed toward said air outlet to said air flow hole;

wherein air passing through said air flow hole is ejected from said air outlet toward said transport path, wherein said air flow hole is formed by an outer surface of said ink ejection head disposed inside said mounting hole and an inner surface of said mounting hole, wherein said sealing material closes a gap between an upstream side in said transport direction on said inner surface of said mounting hole and an upstream side in said transport direction on said outer surface of said ink ejection head, so that a downflow is ejected from only said air flow hole downstream of said ink ejection head toward said transport path in said mounting hole, wherein said air supply unit comprises two fans disposed above said base material, said two fans are disposed, one on one side and one on the other side of said base plate in a width direction orthogonal to said transport direction, each of said two fans blows air downwardly and inwardly as seen in a width direction orthogonal to said transport direction, said two fans are disposed, one on one side and one on the other side of said base plate in said width direction orthogonal to said transport direction, and wherein the air supplied by said two fans is mixed above said base plate, and wherein only said downflow is generated, while no suction airflow is formed between an upper space and a lower space of said base plate, thereby reducing an adhesion of ink mist from ink droplets ejected from said ink ejection port and floating over said base material to the opposite surface of said base plate.

2. The ink-jet printer according to claim 1, wherein a distance between said opposite surface and said transport path in a location downstream of said air outlet is greater than a distance between said opposite surface or said lower surface and said transport path in a location upstream of said air outlet.

3. The ink-jet printer according to claim 1, wherein said air supply unit supplies air to an outer surface of said ink ejection head.

4. The ink-jet printer according to claim 1, wherein:

said at least one mounting hole in said base plate includes a plurality of mounting holes;

said at least one ink ejection head includes a plurality of ink ejection heads;

said ink ejection heads are mounted in said respective mounting holes;

said at least one air outlet includes a plurality of air outlets; and said base plate includes said air outlets positioned downstream of said ink ejection ports of said respective ink ejection heads.

5. The ink-jet printer according to claim 4, wherein the amount of air ejected from a downstream one of said air outlets is less than the amount of air ejected from an upstream one of said air outlets.

6. The ink-jet printer according to claim 1, further comprising an air-permeable filter member positioned in said air flow hole.

7. The ink-jet printer according to claim 1, wherein a gap of said air flow hole in said transport direction is smaller than a distance between said opposite surface and said transport path in a location downstream of said air outlet.

8. The ink-jet printer according to claim 1, wherein said opposite surface of said base plate has no suction opening for sucking an atmosphere present over the base material.

* * * * *